US008915628B2

(12) United States Patent
Yang

(10) Patent No.: US 8,915,628 B2
(45) Date of Patent: Dec. 23, 2014

(54) DECORATIVE CANDLE WITH INNER PATTERN

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 114 days.

(21) Appl. No.: 13/802,764

(22) Filed: Mar. 14, 2013

(65) Prior Publication Data

US 2014/0268670 A1 Sep. 18, 2014

(51) Int. Cl.
*F21V 35/00* (2006.01)
*F21V 3/04* (2006.01)
*F21V 31/04* (2006.01)

(52) U.S. Cl.
CPC ..... *F21V 3/049* (2013.01); *F21V 31/04* (2013.01); *F21V 35/00* (2013.01); *Y10S 362/81* (2013.01)
USPC ..... 362/392; 362/393; 362/810

(58) Field of Classification Search
USPC ..... 362/392, 101, 393, 810
See application file for complete search history.

(56) References Cited

U.S. PATENT DOCUMENTS 2,741,693 A * 4/1956 Fasson ..... 362/810
6,585,387 B1 * 7/2003 Lee ..... 362/101

* cited by examiner

*Primary Examiner* — David V Bruce
(74) *Attorney, Agent, or Firm* — Leong C. Lei

(57) ABSTRACT

A decorative candle with inner pattern includes: a candle main body with inner pattern, and a light-emitting device. The candle main body is made of light-transmittable plastic material, has at least an inner surface and an outer surface. The outer surface is smooth, and the inner surface has a plurality of predefined patterns. The candle main body and the patterns are monolithically formed by blowing. The light-emitting device is disposed inside the candle main body, has at least a light source and an electrical box for providing power to the light source. As such, in the decorative candle with pattern of the present invention, the patterns on the inner surface and the candle main body are monolithically manufactured by blowing, and thus the problems associated with the conventional two-process manufacturing are eliminated.

8 Claims, 9 Drawing Sheets

DECORATIVE CANDLE WITH INNER PATTERN

TECHNICAL FIELD OF THE INVENTION

The present invention generally relates to a decorative candle, and more particularly to a decorative candle with inner pattern manufactured monolithically by blowing.

DESCRIPTION OF THE PRIOR ART

For a long time around the world, the conventional candle has evolved from purely illuminant to decoration and ambient creation in festivals, events, religious ceremonies and home decoration. The conventional candle has become an integral part of daily life in many households.

On the other hand, the conventional candle can cause potential air pollution, darkens surrounding area, and even cause fire. Therefore, an electronic candle is developed to use light-emitting element in a candle-shape structure to replace the burning flame in the conventional candle.

However, because the main body of the known electronic candles is often manufactured by inject molding, and then a process of etching, transfer printing or electroplating is used to process the inner and outer surfaces. The inner surface processing is not only complex but also time-consuming, and is prone to poor yield rate. Therefore, the problems of complexity, time consumption and poor yield rate of the two-time manufacturing process of the known electronic candle make the products less competitive in the mark.

SUMMARY OF THE INVENTION

The primary purpose of the present invention is to solve the problems of complexity, time consumption, poor yield rate and low competitiveness of the two-time manufacturing process of the known electronic candle.

Thus, to achieve the above object, the present invention provides a decorative candle with inner pattern, mainly including: a candle main body with inner pattern, made of light-transmittable plastic material, having at least an inner surface and an outer surface, the outer surface being smooth, the inner surface having a plurality of predefined patterns, the candle main body and the patterns being monolithically formed by blowing; and a light-emitting device, disposed inside the candle main body with pattern, having at least a light source and an electrical box for providing power to the light source.

As such, in the decorative candle with pattern of the present invention, the patterns on the inner surface and the candle main body are monolithically manufactured by blowing, and thus the problems associated with the conventional two-process manufacturing are eliminated.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
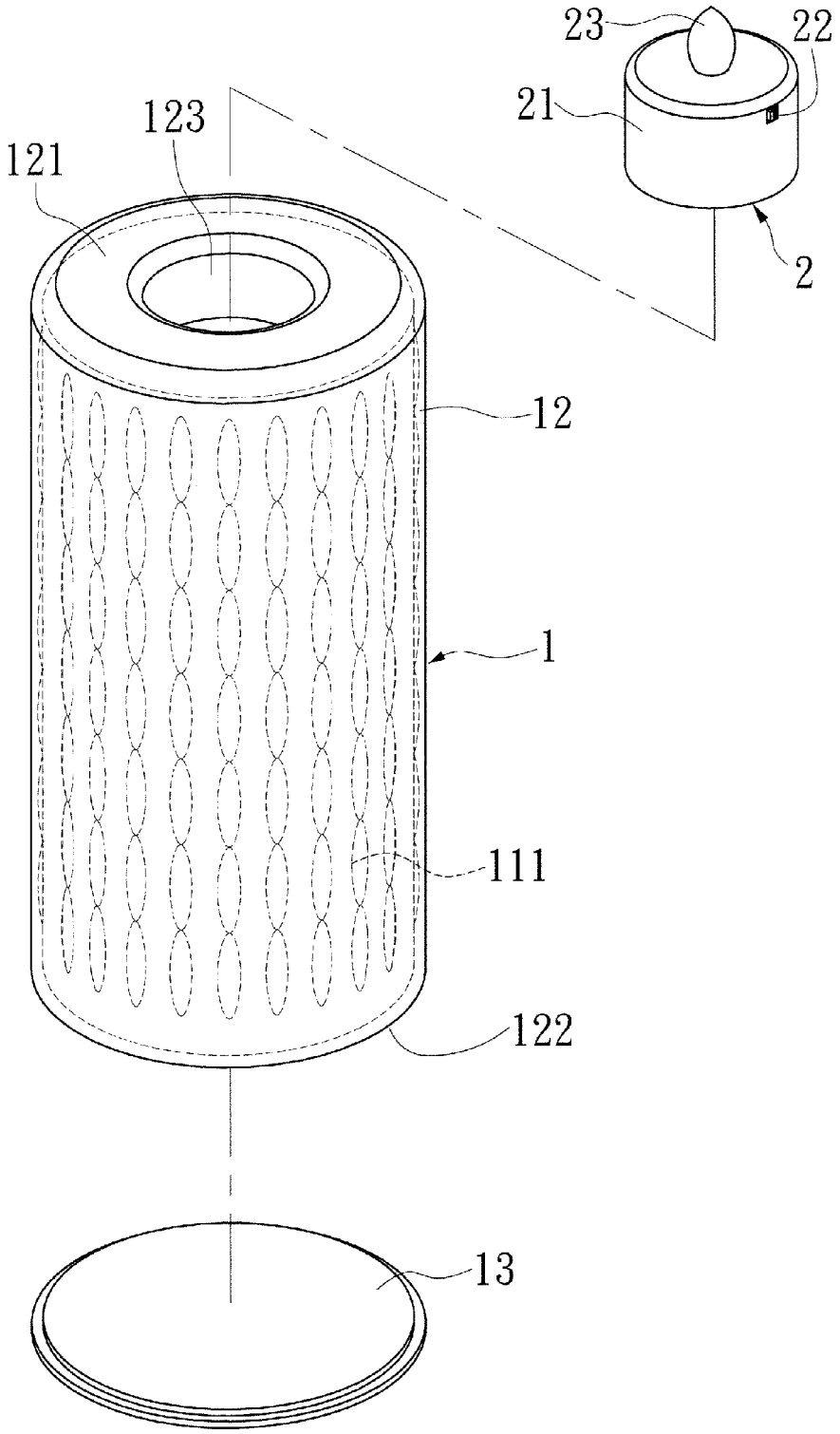
FIG. 1 is a dissected perspective diagram according a first embodiment of the present invention.
Figure 2:
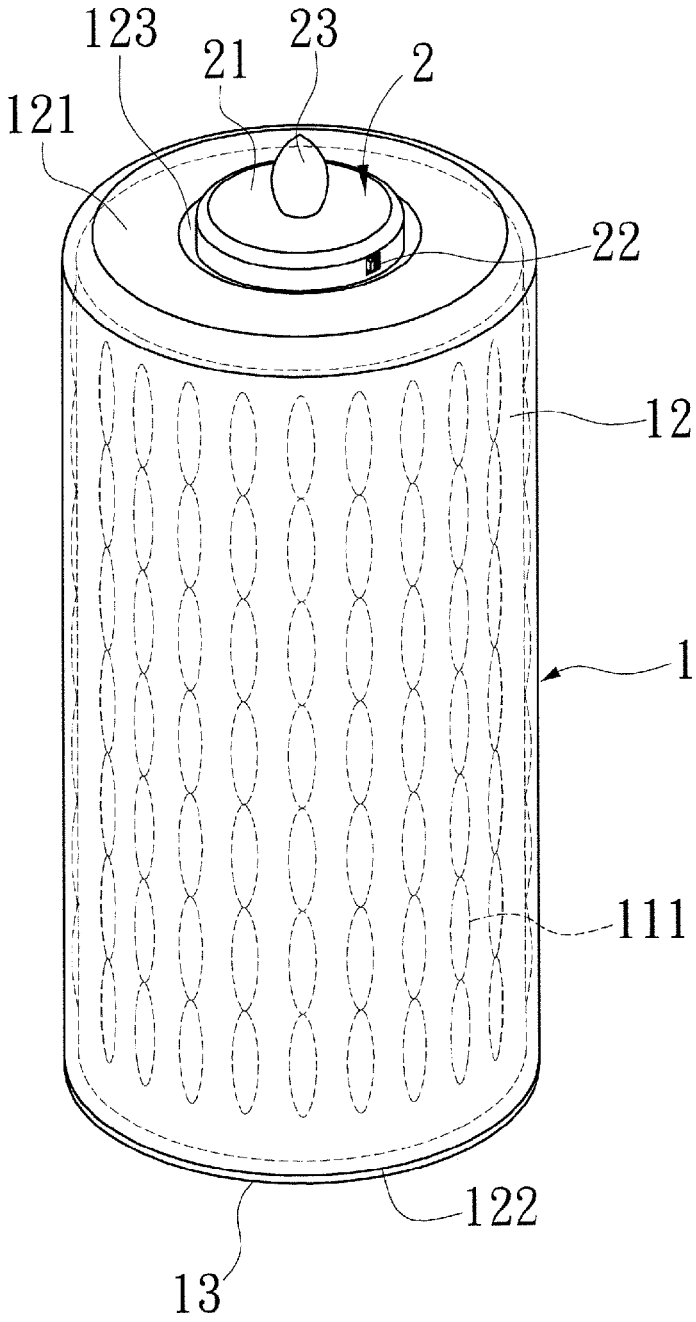
FIG. 2 is a perspective diagram according a first embodiment of the present invention.
Figure 3:
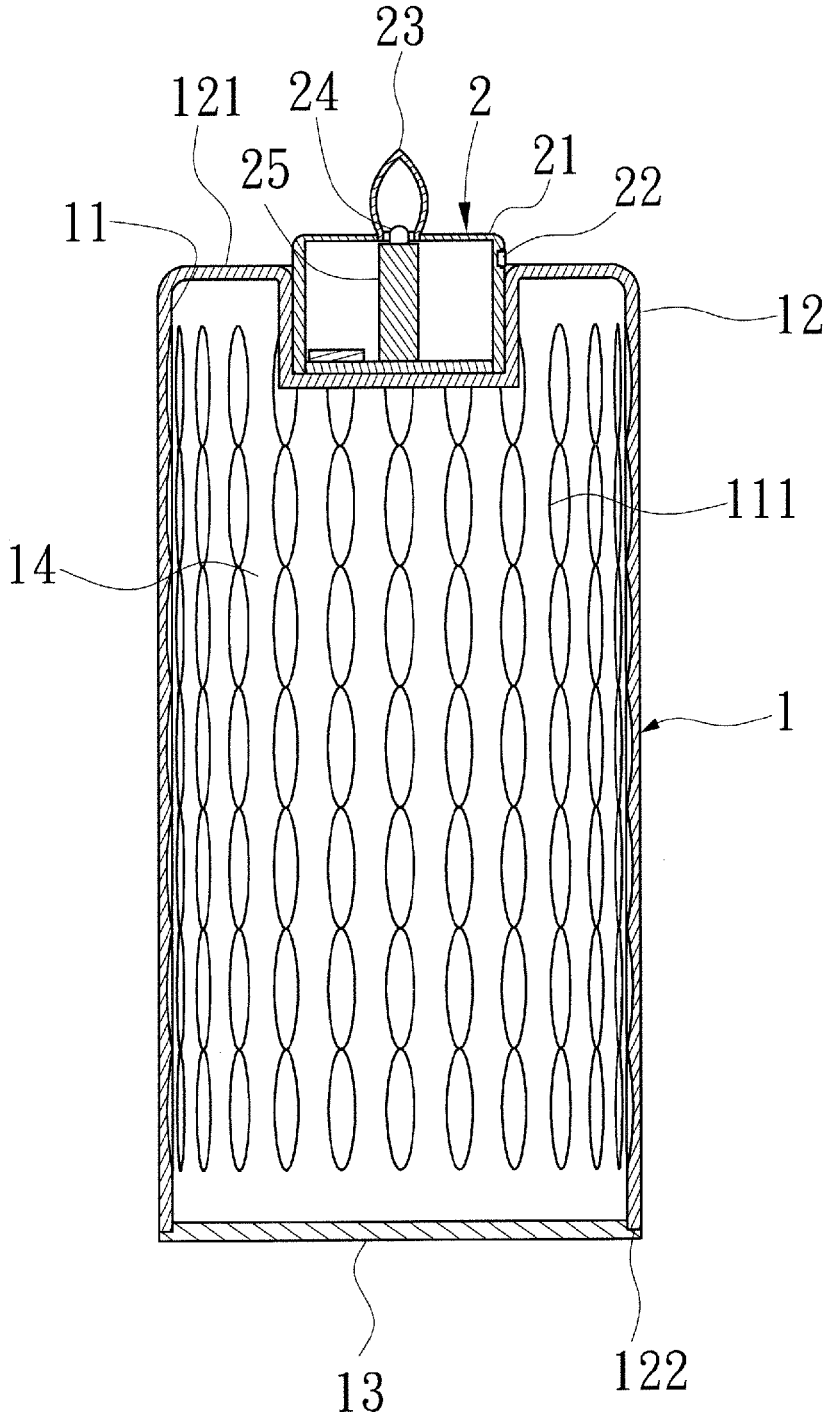
FIG. 3 is a cross-sectional diagram according a first embodiment of the present invention.

As shown in FIGS. 1 to 3, the first embodiment of the decorative candle with inner pattern includes: a candle main body with inner pattern 1 and a light-emitting device 2.

The candle main body with inner pattern 1 is made of light-transmittable plastic material, and has at least an inner surface 11 and an outer surface 12, wherein the outer surface 12 is a smooth surface and the inner surface 12 includes a plurality of predefined patterns 111. In the present embodiment, patterns are continuous and repetitive. However, non-continuous or non-repetitive patterns can also be used. The candle main body 1 and the patterns 111 are monolithically formed by blowing. The outer surface further 12 includes a top 121 and a bottom 122, wherein the top 121 includes a concave part 123 and the light-emitting device 2 is disposed inside the concave part 123. The light-emitting device 2 includes a light source 24 and an electrical box 21 for providing power to the light source 24. In the present embodiment, the light source 24 is a light-emitting diode (LED). A switch 22 and a shade 23 are disposed externally to the electrical box 21. The electrical box 22 houses a circuit board 25. The switch 22 can control the ON and OFF of the light source 24. Because the light-emitting device 2 can use various power sources and light sources, the present embodiment does not describe in details here.

Figure 4:
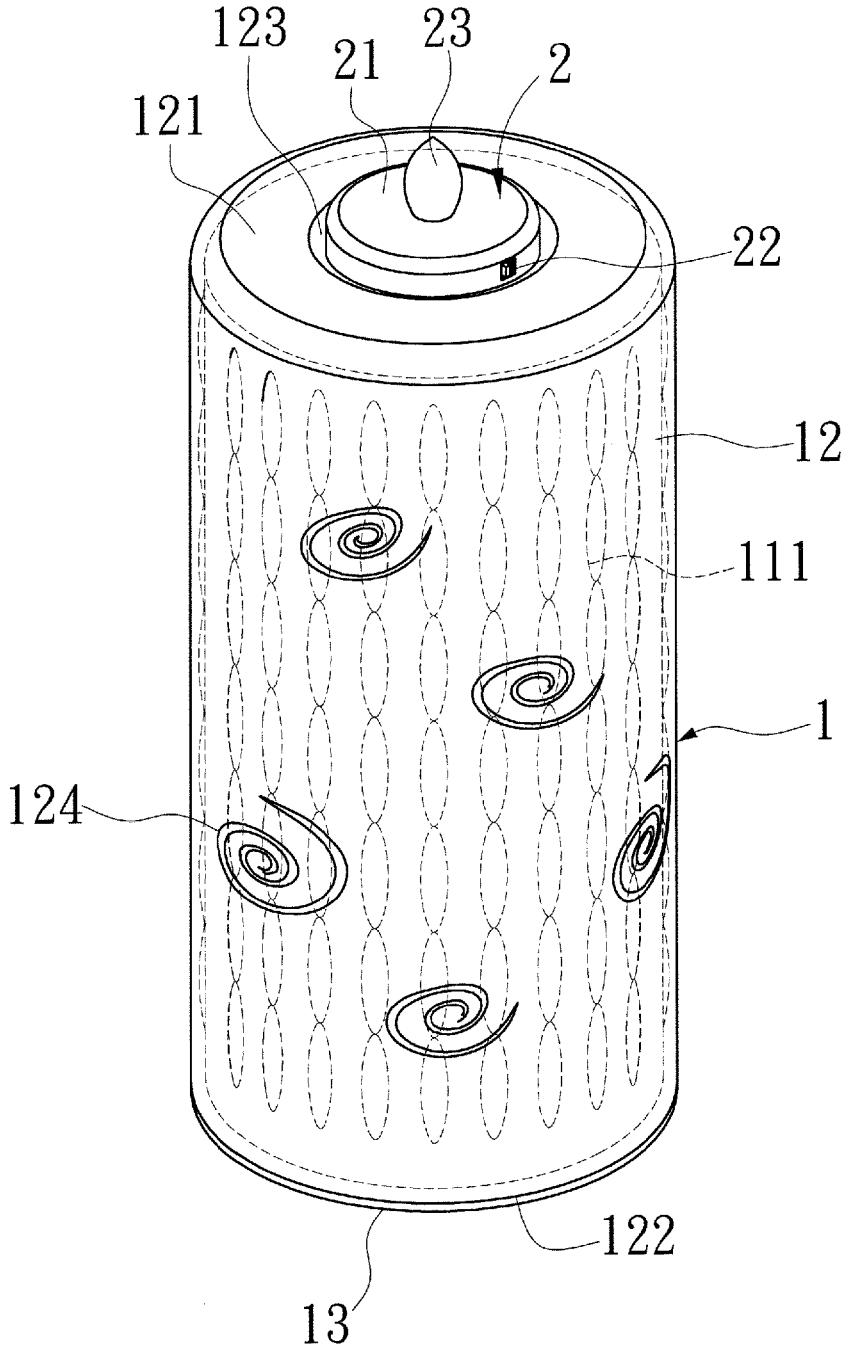
FIG. 4 is a perspective diagram according a first embodiment of the present invention.

As shown in FIG. 4, the outer surface 12 of the candle main body with pattern 1 can further includes a plurality of patterns 124. The patterns 124 on the outer surface 12 can be formed monolithically with the candle main body with inner pattern 1, or formed by etching, electroplating, painting, and so on. The patterns 124 can be different from the patterns 111 on the inner surface 11 of the candle main body with inner pattern 1 so that the inner surface 11 and the outer surface 12 in the present embodiment can display different decorative effects.

Figure 5:
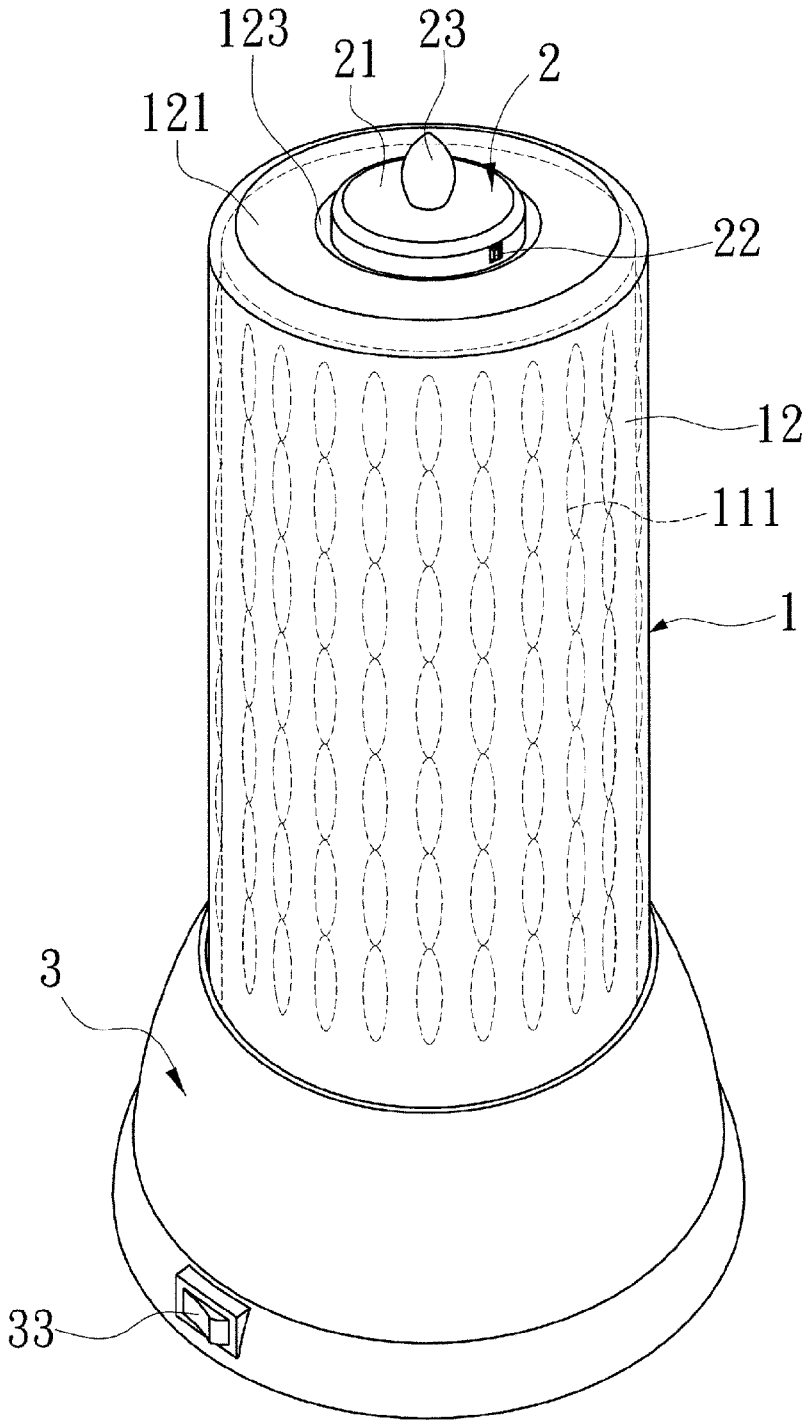
FIG. 5 is a perspective diagram according a second embodiment of the present invention.
Figure 6:
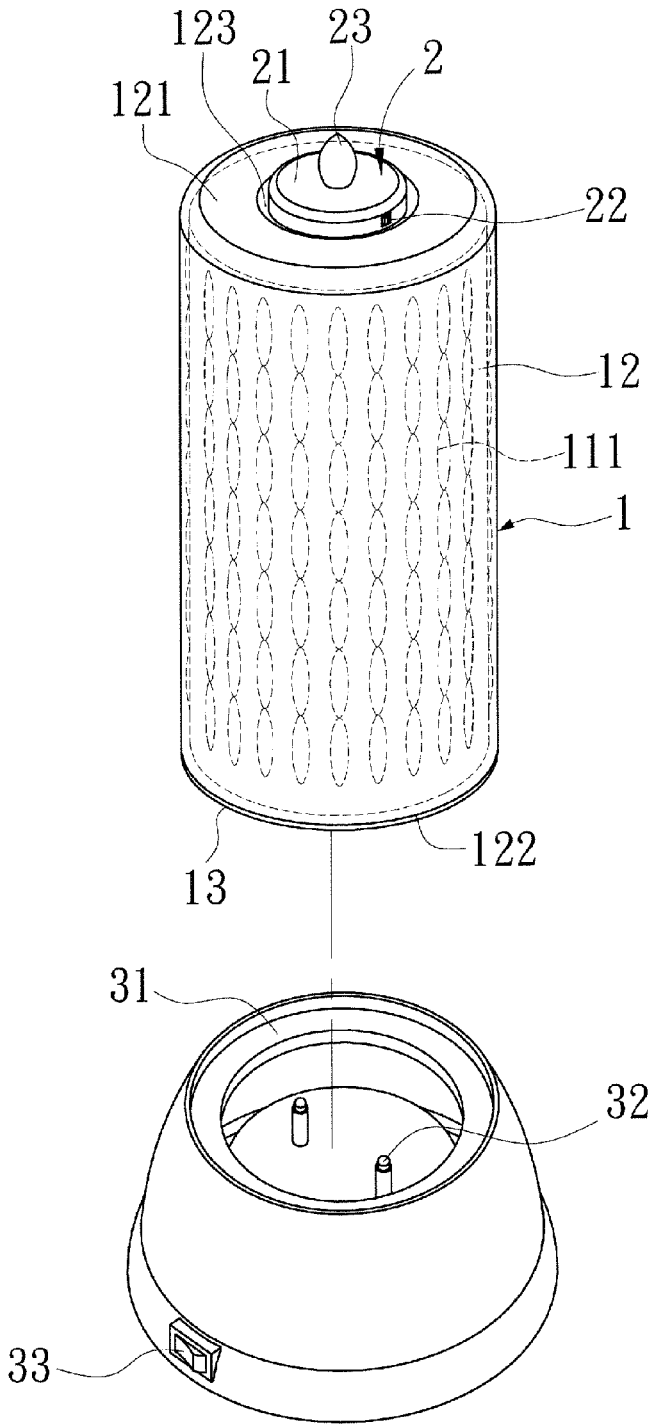
FIG. 6 is a dissected perspective diagram according a second embodiment of the present invention.
Figure 7:
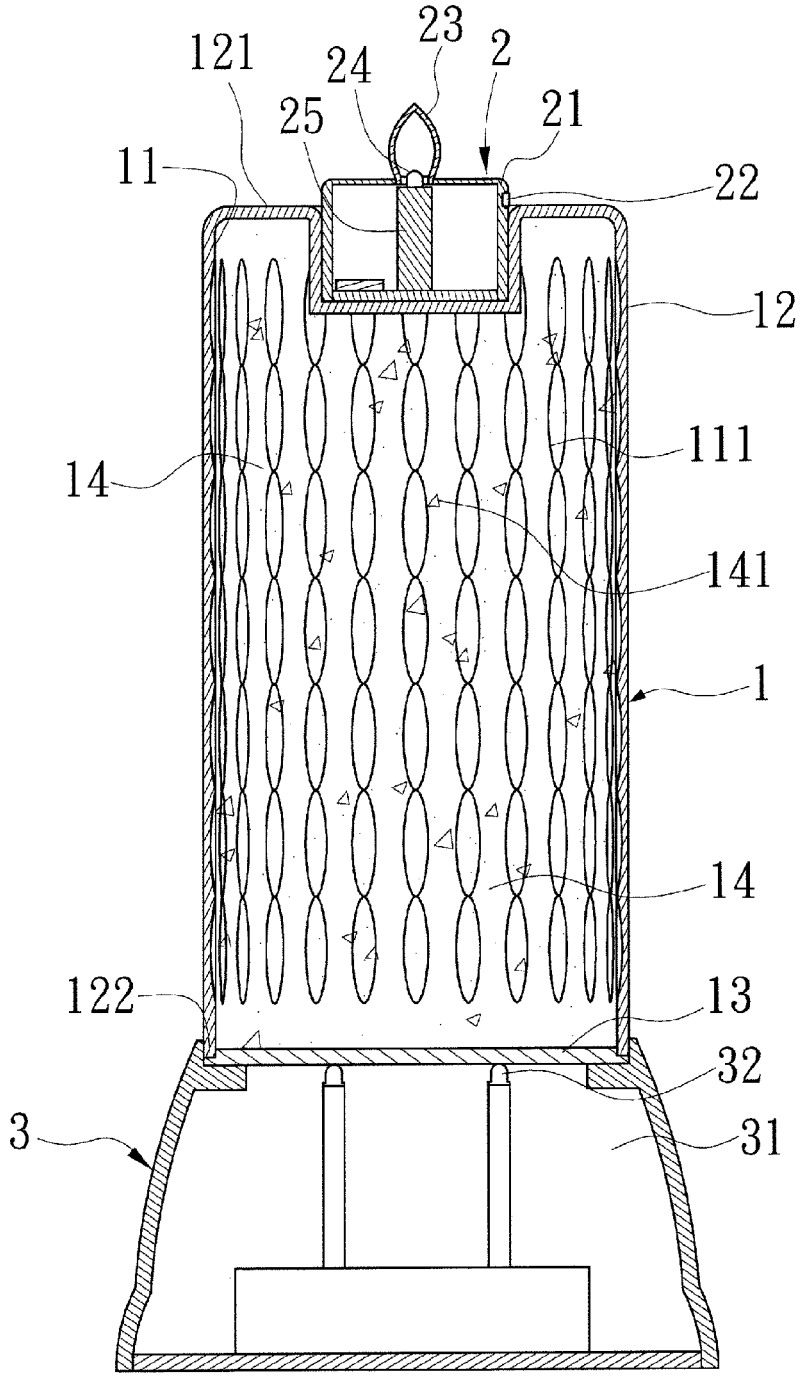
FIG. 7 is a cross-sectional diagram according a second embodiment of the present invention.

Refer to FIGS. 5-7 for the second embodiment of the present invention.

The candle main body with inner pattern 1 further includes a light-transmittable bottom cover 13, fixedly engaged to the bottom 122 of the candle main body with inner pattern 1. In the present embodiment, the bottom cover 13 is glued to the bottom 122 of the candle main body with inner pattern 1. Also, the candle main body with inner pattern 1 and the bottom cover 13 form a hollow housing chamber 14, able for filling with a flowing fluid doped with glittering bits 141. Furthermore, the bottom cover 13 of the candle main body with inner pattern 1 is connected to a base 3. The base 3 includes a concave trench 31 corresponding to the bottom cover 13 of the candle main body with inner pattern 1. The concave trench 31 id disposed with two LEDs 32 at the bottom. The outer circumference of the base 3 is disposed with a switch 33, and the switch 33 is electrically connected to the power source (not shown) and LEDs 32.

Therefore, when pressing the switch 33 of the base 3, the power form the power source propagates to the LEDs 32 through the switch 33 so that LEDs 32 can emit light, and the light passes through the bottom cover 13, the fluid doped with glittering bits 141 inside hollow housing chamber 14 and the outer surface 12 to project onto the outside. The fluid doped with glittering bits 141 inside hollow housing chamber 14 can further enhance the decorative effect of the present invention.

Figure 8:
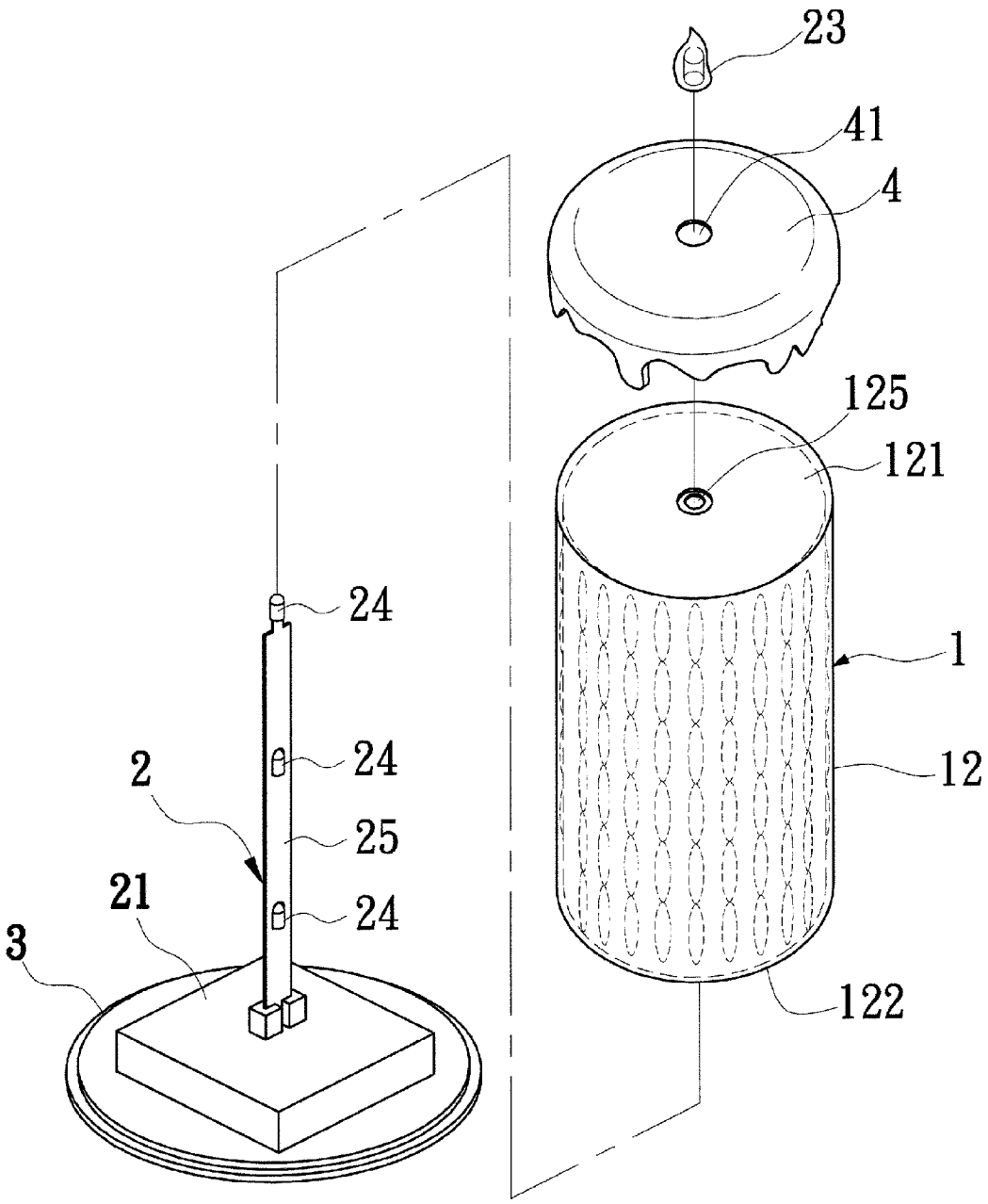
FIG. 8 is a dissected perspective diagram according a third embodiment of the present invention.
Figure 9:
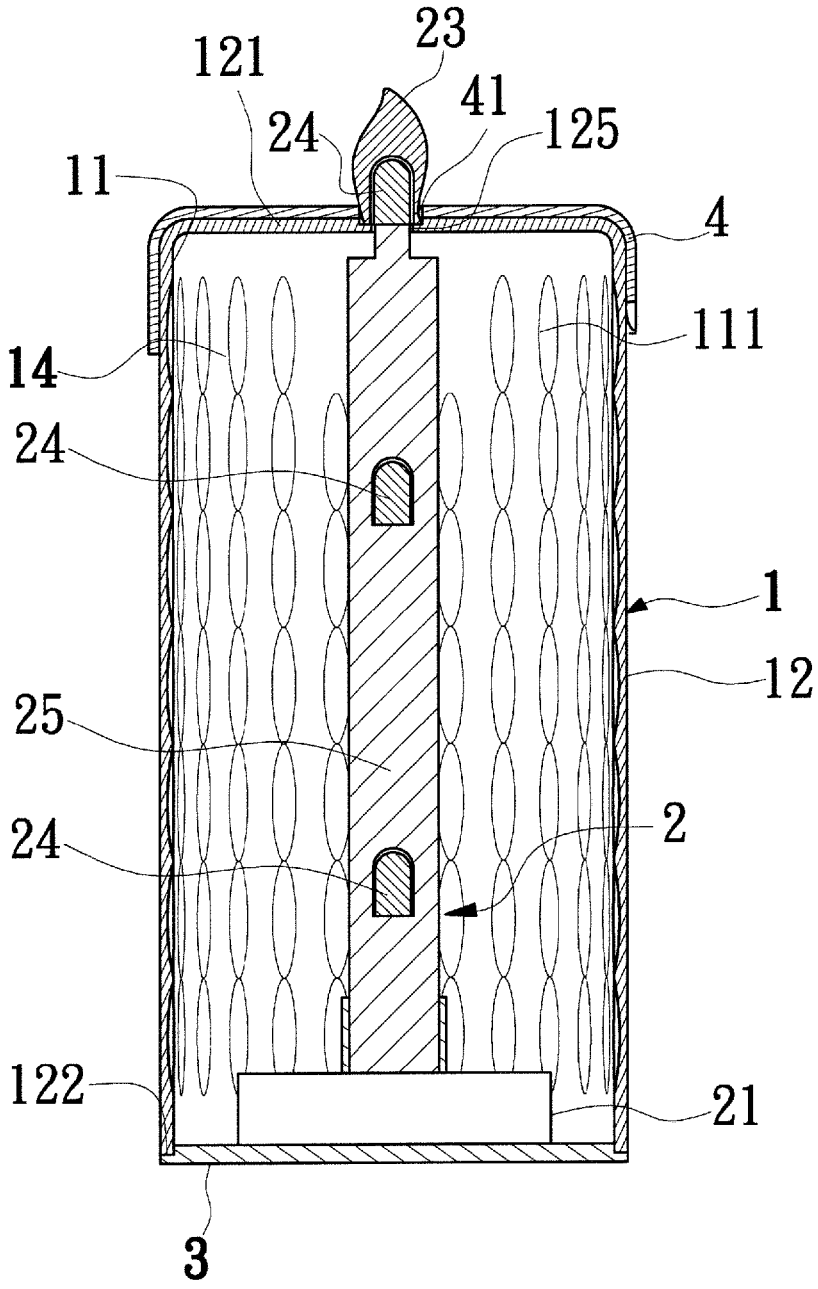
FIG. 9 is a cross-sectional diagram according a third embodiment of the present invention.

Refer to FIGS. 8-9 for the third embodiment of the present invention. A hole 125 is disposed at the top 121 of the candle main body with inner pattern 1, and the shade 23 is disposed to cover on the hole 125. The light-emitting device 2 is disposed inside the candle main body with inner pattern 1 and the light source 24 extends beyond the hole 125 to expose and housed inside the shade 23. Also, the present embodiment further comprises an outer decorative body 4 having a via 41. The outer decorative body 4 is disposed on the top 121 of the candle main body with inner pattern 1 and the shade 126 is exposed through the via 41. The shape of the outer decorative body 4 is like a drop of melt was to further imitate the image of a conventional candle with burning flame. In addition, the bottom 122 of the candle main body with inner pattern 1 is connected to the base 3. The light-emitting device 2 is disposed inside the base 3 and extends into the candle main body with inner pattern 1 to dispose a plurality of light sources 24 inside the candle main body with inner pattern 1 so that the candle main body with inner pattern 1 and the shade 23 can both emit light.

As such, the candle main body with inner pattern 1 is manufactured monolithically by blowing, and the injection followed by blowing can be performed on the same machine so as to form specific patterns 111 on the inner surface 11 of the candle main body with inner pattern 1. As a result, the problems associated with the known two-process manufacturing of conventional electronic candle can be eliminated.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A decorative candle with inner pattern, mainly comprising:

a candle main body with inner pattern, made of light-transmittable plastic material, having at least an inner surface and an outer surface, the outer surface being smooth, the inner surface having a plurality of predefined patterns, the candle main body and the patterns being monolithically formed by blowing; and a light-emitting device, disposed inside the candle main body with pattern, having at least a light source and an electrical box for providing power to the light source.

2. The decorative candle with inner pattern according to claim 1, wherein the outer surface further comprises a top and a bottom, the top comprises a concave part and the light-emitting device is disposed inside the concave part.

3. The decorative candle with inner pattern according to claim 1, wherein the candle main body with inner pattern further comprises a light-transmittable bottom cover, fixedly engaged to the bottom of the candle main body with inner pattern.

4. The decorative candle with inner pattern according to claim 3, wherein the candle main body with inner pattern and the bottom cover form a hollow housing chamber, able for filling with a flowing fluid.

5. The decorative candle with inner pattern according to claim 3, wherein the candle main body with inner pattern is connected to a base, and the base comprises a concave trench corresponding to the bottom cover of the candle main body with inner pattern.

6. The decorative candle with inner pattern according to claim 1, wherein the candle main body with inner pattern further comprises a top and a bottom, the top is disposed with a hole and a shade is disposed to cover the hole, the light-emitting device is disposed inside the candle main body with inner pattern and the light source extends beyond the hole to expose and housed inside the shade.

7. The decorative candle with inner pattern according to claim 6, further comprising an outer decorative body with a via, the outer decorative body is disposed to the top of the candle main body with inner pattern and the shade exposes through the via.

8. The decorative candle with inner pattern according to claim 6, wherein the candle main body with inner pattern is connected to a base.

* * * * *